United States Patent [19]

Wei

[11] 4,358,062

[45] Nov. 9, 1982

[54] TILTED LIFTERS FOR AUTOGENOUS MILLS

[76] Inventor: Yun-Song Wei, 2319 Bayou Blvd., Pensacola, Fla. 32503

[21] Appl. No.: 159,666

[22] Filed: Jun. 16, 1980

[51] Int. Cl.[3] ..... B02C 17/22

[52] U.S. Cl. ..... 241/284; 241/183; 241/299

[58] Field of Search ..... 241/181, 183, 91, 284, 241/299, 182, 26, 70, 71, 72, 76, 78, 79.2, 79.3

[56] References Cited

U.S. PATENT DOCUMENTS

| | | | |
|---|---|---|---|
| 1,525,622 | 2/1925 | Stocker | 241/181 |
| 2,470,315 | 5/1949 | McGeehee | 241/183 X |

FOREIGN PATENT DOCUMENTS

| | | | |
|---|---|---|---|
| 479488 | 11/1975 | U.S.S.R. | 241/181 |
| 623578 | 9/1978 | U.S.S.R. | 241/183 |

*Primary Examiner*—Mark Rosenbaum

[57] ABSTRACT

In autogenous mills, lifters used on shell and end linings are so constructed with their teeth tilted toward the direction of rotation of the mill in such a way that teeth of lifters statistically coincide to the mean velocity of falling rocks relative to moving lifters.

7 Claims, 5 Drawing Figures

TILTED LIFTERS FOR AUTOGENOUS MILLS

BACKGROUND OF THE INVENTION

It is a common practice to make teeth of lifters perpendicular to the wall of the autogenous mill. Yet for such an installation, as the mill turns, the direction of velocity of falling rocks relative to teeth of lifters will be inclined to the direction of the latter (FIG. 2). The intermittent side impact of rocks on teeth of lifters causes the latters to vibrate, and also causes uneven wear pattern of the lifters. For the above reason, for example, lifter bars of Allis-Chalmers Rockcyl autogenous mills are forced to be designed for easy removal, reversal and replacement, and the new Rockcyl primary autogenous mills have to reverse the direction of rotation of mills on time to achieve balanced lifter and liner life.

In addition to the above inconveniences, the rock holding ability of such lifters is comparatively low. The mill is then forced to run faster (up to 83% to 87% of its critical speed) for greater centrifugal force so as to maintain reasonable lifting of rocks. Under the influence of such centrifugal force, fine particles sticking on the wall of the mill will turn round in it (FIG. 3), and will be difficult to be drawn out of the mill by the suction pipe located at the center of the mill. As a result, the efficiency of the mill drops down, and the percentage of undesired fines in the final product increases.

FIELD OF THE INVENTION

The invention relates to tilted lifters for autogeneous mills. For primary autogenous mills where impact of rocks on the lifters is severe, the invention makes the wear pattern of lifters reasonably even. While for all kinds of autogenous mills, tilted lifters increase the rock holding ability of the mill, cut down its speed and power consumption, increase the efficiency of the mill, and improve the uniformity of the grain size of the final product.

REFERENCE TO DRAWINGS

1 is the vertical lifter;

$V_1$ is the mean absolute velocity of rocks;

$V_2$ is the absolute velocity of the lifter; and $V_R$ is the velocity of rock relative to the lifter.

Figure 3:
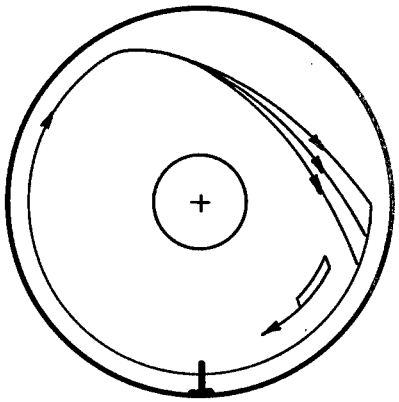

FIG. 3 is an illustration of the locus of falling fines in a prior art autogeneous mill.

Figure 1:
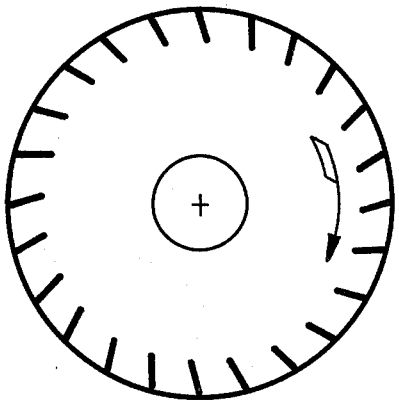
FIG. 1 is a cross-sectional view of the preferred embodiment.
Figure 2:
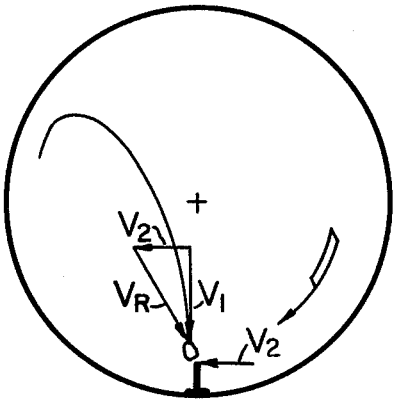
FIG. 2 is an illustration of a moving autogenous mill of the prior art form, showing the sidewise velocity of the falling rock relative to the lifter, where.
Figure 4:
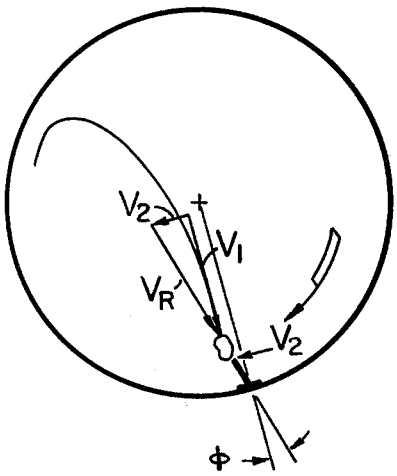

FIG. 4 is an illustration of impact model of the rock on the lifter according to this invention. The notations have the same meanings as those given in FIG. 2 above.

$\phi = 20° - 45°$.

2 is the inclined lifter.

Figure 5:
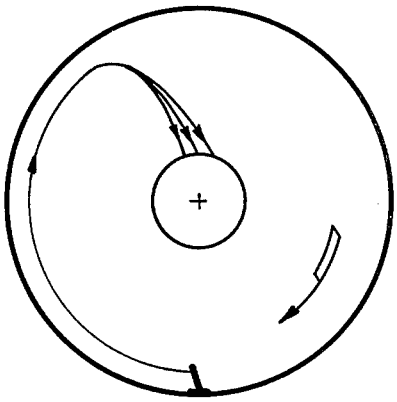

FIG. 5 is an illustration of the locus of falling fines according to this invention.

SUMMARY OF THE INVENTION

In the present invention, teeth of lifters of autogenous mills are tilted toward the direction of motion of the mill, in such a manner that the center line of lifters coincides to the statistic mean locus of falling rocks relative to lifters.

A primaary object of the invention is to eliminate the side impact of the falling rocks relative to the teeth of lifters (FIG. 4), making the wear pattern of lifters to be reasonably even.

A further object is to cut down the speed and power consumption of the mill due to stronger rock holding ability of tilted lifters.

A further object is to prolong the service lift of clamping bolts between reclampings due to elimination of the side impact.

A further object is to allow crushed fine particles to fall nearer to the center of the mill (FIG. 5) due to reduced speed of the latter, making them easier to be drawn out of the mill by the suction pipe located at the center of the mill. This will result in increase of the mill efficiency and reduction of the percentage of undesired fines in the final product.

DETAILED DESCRIPTION OF THE INVENTION

The teeth of lifter 2 in FIG. 4 are tilted toward the direction of motion of the autogenous mill in such a manner that the center line of the lifter teeth coincide with the statistic mean locus of falling rocks relative to the lifter. The lifter center line refers to the axis of symmetry of the cross-section of the lifter. The mean locus of the falling rocks coincides with the center line of the lifters assuming the lifters wear is even on both sides of the lifter. With this arrangement, the wear pattern of the lifters becomes reasonably even throughout its cross section. Furthermore the center line is made straight instead of spiral for better resistance to buckling. Finally, the lifters are at an angle to the mill of 20°–45° and the mill operating speed is 60 to 80% of its critical speed. The exact angle and operating speed depend on various optimum working situation such as best efficiency of the mill, best quality of the final product, lowest value of kilowatt hours per ton, and even wear pattern on the lifters.

The invention is, of course, not limited to the specific embodiments described and illustrated, but may be realized in various modifications and substitutions without departing from the spirit and scope of the appended claims.

I claim:

1. In an autogenous mill including a casing and a number of lifters on both shell and liners within the casing, the improvement comprising said lifters having teeth which are inclined toward the direction of motion of the mill, said teeth having a center line which will substantially coincide with a mean locus of falling rocks within the mill, said mean locus being substantially a logarithmic spiral, said center line being straight for better resistance to buckling.

2. An improvement according to claim 1, in which said lifters are fixed at an angle of 20°–45° as determined by optimum working conditions, the mill operating at a speed of 60% to 80% of its critical speed.

3. An improvement according to claim 2 in which the optimum working situation is the best efficiency of the mill.

4. An improvement according to claim 2 in which the optimum working situation is the best quality of the final product.

5. An improvement according to claim 2 in which the optimum working situation is the lowest value of kilowatt hours per ton of the material.

6. An improvement according to claim 2 in which the optimum situation is the even wear pattern of the lifters.

7. An improvement according to claim 2 in which said lifter angle and said operating speed are determined by optimum working conditions.

* * * * *